US011413669B2

(12) United States Patent
Dagner

(10) Patent No.: US 11,413,669 B2
(45) Date of Patent: Aug. 16, 2022

(54) LOCALLY CHANGING THE ROLL GAP IN THE REGION OF THE STRIP EDGES OF A ROLLED STRIP

(71) Applicant: Primetals Technologies Germany GmbH, Erlangen (DE)

(72) Inventor: Johannes Dagner, Erlangen (DE)

(73) Assignee: PRIMETALS TECHNOLOGIES GERMANY GMBH

( * ) Notice: Subject to any disclaimer, the term of this patent is extended or adjusted under 35 U.S.C. 154(b) by 132 days.

(21) Appl. No.: 16/751,547

(22) Filed: Jan. 24, 2020

(65) Prior Publication Data

US 2020/0238353 A1 Jul. 30, 2020

(30) Foreign Application Priority Data

Jan. 28, 2019 (EP) ..... 19153870

(51) Int. Cl.
*B21B 37/62* (2006.01)
*B21B 1/26* (2006.01)

(52) U.S. Cl.
CPC ..... *B21B 37/62* (2013.01); *B21B 1/26* (2013.01)

(58) Field of Classification Search
CPC . B21B 2263/02; B21B 2205/02; B21B 31/18; B21B 31/20; B21B 31/32; B21B 37/40; B21B 2269/12; B21B 2269/14; B21B 2027/022; B21B 37/58; B21B 37/62; B21B 38/10; B21B 38/105; B21B 2271/02
USPC ..... 72/249
See application file for complete search history.

(56) References Cited

U.S. PATENT DOCUMENTS 4,703,641 A * 11/1987 Yarita ..... B21B 37/40 72/247
4,730,475 A * 3/1988 Ginzburg ..... B21B 13/142 72/199
4,823,585 A * 4/1989 Hishinuma ..... B21B 31/18 72/199

(Continued)

FOREIGN PATENT DOCUMENTS

EP 2 548 665 B1 2/2014
GB 2 223 43 5 A 4/1990

(Continued)

OTHER PUBLICATIONS

European Search Report dated Aug. 27, 2019 in corresponding European Patent Application No. 19153870.1.

(Continued)

*Primary Examiner* — Jessica Cahill
*Assistant Examiner* — Bobby Yeonjin Kim
(74) *Attorney, Agent, or Firm* — Ostrolenk Faber LLP

(57) ABSTRACT

Methods and apparatus for locally changing a roll gap in the region of the strip edges (10) of a rolled strip (1) in a rolling stand (2). The roll gap can be changed locally in the region of the strip edges (10) of the strip (1) during the hot rolling. Axial displacement of the working rollers (3, 4) in opposite directions is by a displacement distance s, where s is greater than or less than $\Delta r/\tan(\alpha)$ and $\Delta r$ indicates the wear of the running surface (8) in the radial direction (R) and $\alpha$ indicates the pitch angle of the conical portion (7) of the respective working roller (3, 4).

6 Claims, 10 Drawing Sheets

(56) References Cited

U.S. PATENT DOCUMENTS

| | | | | |
|---|---|---|---|---|
| 7,093,473 | B2 * | 8/2006 | Honjo | B21B 13/142 72/241.2 |
| 7,757,531 | B2 * | 7/2010 | Klockner | B21B 13/142 72/252.5 |
| 7,913,531 | B2 * | 3/2011 | Huang | B21B 27/021 72/252.5 |
| 2003/0177807 | A1 * | 9/2003 | Bobig | B21B 37/28 72/247 |
| 2019/0308232 | A1 | 10/2019 | Arvedi et al. | |

FOREIGN PATENT DOCUMENTS

| | | | |
|---|---|---|---|
| JP | S60-244408 | A | 12/1985 |
| JP | H01-321007 | A | 12/1989 |
| RU | 2615670 | C1 | 4/2017 |
| SU | 1049130 | A1 | 10/1983 |
| WO | WO 2017/215595 | A1 | 12/2017 |

OTHER PUBLICATIONS

Russian Federation Office Action, dated Nov. 29, 2021, issued in corresponding Russian Patent Application No. 2020103343/05(005086). Total 12 pages.

* cited by examiner

LOCALLY CHANGING THE ROLL GAP IN THE REGION OF THE STRIP EDGES OF A ROLLED STRIP

CROSS-REFERENCE TO RELATED APPLICATIONS

The present application claims priority of European Patent Application No. EP 19153870.1 filed Jan. 28, 2019, the contents of which are incorporated by reference herein.

TECHNICAL FIELD

The present invention relates to the technical field of hot rolling technology, specifically the hot rolling of a metal material, in particular steel or aluminum, into a rolled strip in a rolling stand.

PRIOR ART

WO 2017/215595 A1 discloses upper and lower working rollers of a rolling stand, each having a conical portion, an inwardly extending running surface and a cylindrical end. The upper working roller is fitted in the rolling stand in the opposite direction to the lower working roller. To prolong a rolling campaign, it is proposed to displace the working rollers in opposite axial directions during the rolling. In this case, one strip edge of the rolled strip always lies on the edge between the conical portion and the running surface. This measure allows the service life of the working rollers in a rolling campaign to be extended to 150 km and more without changing or regrinding the working rollers. The document does not disclose how the roll gap between the upper working roller and the lower working roller can be specifically changed locally in the region of the strip edges of the rolled strip.

SUMMARY OF THE INVENTION

The object of the invention is to provide a method and an apparatus for locally changing the roll gap in the region of the strip edges of a strip being rolled in a rolling stand. It is intended that during hot rolling the roll gap can be specifically increased or reduced in size locally in the region of the strip edges of the strip, without changing the roll gap overall. A local changing of the roll gap is intended to lead to a local changing of the decrease in thickness in the region of the strip edges of the strip. It is intended by the local changing of the roll gap that the planarity or the profile of the strip can be influenced. Nevertheless, it is intended that the uninterrupted hot rolling of the strip in the rolling stand can be maintained over a long time without the working rollers having to be changed or reground.

A local changing of the roll gap means a changing (by reduction or increase in size) of the roll gap locally, i.e. concerning the region of the strip edges of a rolled strip. This allows the roll gap to be changed locally in the region of the strip edges without changing the roll gap overall. That gap is set for example by the vertical distance between the upper working roller and the lower working roller. The local region of the strip edges may for example account for up to 20% of the strip width. In the case of a non-local, i.e. overall, changing of the roll gap, the roll gap is changed over the entire width of the strip. An increase in the size of the roll gap leads to a smaller decrease in thickness of the strip being rolled, whereas a reduction in the size of the roll gap leads to a greater decrease in thickness of the strip being rolled.

On the one hand, the object according to the invention is achieved by a method for locally increasing the size of a roll gap in the region of the strip edges of a rolled strip in a rolling stand, wherein the rolling stand comprises:

- an upper working roller and a lower working roller, wherein each working roller has two ends for rotational mounting of the working roller in chocks,
- wherein each working roller has in its axial direction a conical portion followed by a running surface,
- wherein the upper working roller is fitted in the opposite direction to the lower working roller,
- wherein each working roller has a separate displacing device for axially displacing the working roller.

The method comprises the method steps of:

- hot rolling a rolled stock in the rolling stand, wherein the radial extent of the running surface of a working roller decreases by Δr during the rolling,
- axially displacing the working rollers in opposite directions by a displacement distance $$s > \frac{\Delta r}{\tan(\alpha)},$$

where Δr indicates the wear of the running surface in the radial direction and a indicates the pitch angle of the conical portion of the respective working roller.

With respect to the working rollers, a local increase in the size of the roll gap in the region of the strip edges of the strip is accompanied by a reduction of at least a local roller diameter of the working rollers in the region of the strip edges.

The rolling stand and the working rollers of the rolling stand are for example designed according to WO 2017/215595. In the present invention, however, it is not absolutely necessary that the running surfaces of the working rollers are made to be inwardly extending. The rolled stock is hot-rolled in the roll gap between the upper working roller and the lower working roller of the rolling stand. As a result, the working rollers become worn by their contact with the rolled stock. Specifically, the running surfaces of the working rollers become worn, and the radius of the running surfaces decreases by Δr. In order to avoid worn edges in the running surfaces of the working rollers, the working rollers are respectively displaced in opposite axial directions, for example the upper working roller is displaced to the right and the lower working roller is displaced to the left. If a respective working roller is displaced by a displacement distance $$s > \frac{\Delta r}{\tan(\alpha)},$$

the local roll gap is increased in size in the region of the strip edges of the strip, whereby the profile or the planarity of the rolled strip can be specifically influenced. The local increase in size of the roll gap in the region of the strip edges has the effect that the strip becomes somewhat thicker in this region than in other regions. In other words, the so-called edge drop in the region of the strip edges is reduced. This has a direct and immediate effect on the profile or the planarity of the strip. In simplified terms, the strip edges or the region of the strip edges of the strip are relieved of loading as a result of the local increase in size of the roll gap in the region of the strip edges. Δr indicates the wear of the running surface of a working roller in the radial direction and a indicates the pitch angle of the conical portion of the respective working roller.

In an equivalent way, for locally increasing the size of a roll gap in the region of the strip edges of a rolled strip, the axial displacement rate v, i.e. the first time derivative of the displacement distance s, of the working roller may be set to a value $$v \equiv \dot{s} > \frac{\dot{\Delta r}}{\tan(\alpha)}.$$

$\dot{\Delta}r$ indicates the rate of wear of the running surface of a working roller in the radial direction. It is possible that the displacement rate v is set to a value greater than $$\frac{\dot{\Delta r}}{\tan(\alpha)}$$

over a relatively long time, or that the displacement rate v is only set to a value greater than $$\frac{\dot{\Delta r}}{\tan(\alpha)}$$

within a limited time window during operation.

On the other hand, the object according to the invention is achieved by a method for locally reducing the size of a roll gap in the region of the strip edges of a rolled strip in a rolling stand comprising:

an upper working roller and a lower working roller, wherein each working roller has two ends for rotational mounting of the working roller in chocks, wherein each working roller has in the axial direction a conical portion followed by a running surface, wherein the upper working roller is fitted in the opposite direction to the lower working roller, wherein each working roller has a separate displacing device for axially displacing the working roller.

The method steps of:

hot rolling a rolled stock in the rolling stand, the radial extent of the running surface of a working roller decreasing by Δr during the rolling, axially displacing the working rollers in opposite directions by a displacement distance $$s < \frac{\Delta r}{\tan(\alpha)},$$

where Δr indicates the wear of the running surface in the radial direction and α indicates the pitch angle of the conical portion of the respective working roller.

With respect to the working rollers, a local reduction in the size of the roll gap in the region of the strip edges of the strip is accompanied by an increase of at least a local roller diameter of the working rollers in the region of the strip edges.

Also in the above described embodiment, the rolling stand and the working rollers of the rolling stand may for example be designed according to WO 2017/215595. Here, too, it is not absolutely necessary that the running surface of the working rollers be made inwardly extending. By contrast, a respective working roller is displaced by a displacement distance $$s < \frac{\Delta r}{\tan(\alpha)}.$$

As a result, the local roll gap is reduced in size in the region of the strip edges of the strip, whereby the profile or the planarity of the rolled strip can be specifically influenced. The local reduction in size of the roll gap in the region of the strip edges has an effect that the strip becomes somewhat thinner in this region than in other regions. In other words, the so-called edge drop in the region of the strip edges is increased. This has a direct and immediate effect on the profile or the planarity of the strip. In simplified terms, the strip edges or the region of the strip edges of the strip are subjected to loading as a result of the local reduction in size of the roll gap in the region of the strip edges. Δr again indicates the wear of the running surface of a working roller in the radial direction and a indicates the pitch angle of the conical portion of the respective working roller.

In an equivalent way, for locally reducing the size of a roll gap in the region of the strip edges of a rolled strip, the axial displacement rate v, i.e. the first time derivative of the displacement distance s, of the working roller may be set to a value $$v \equiv \dot{s} < \frac{\dot{\Delta r}}{\tan(\alpha)}.$$

$\dot{\Delta}r$ indicates the rate of wear of the running surface of a working roller in the radial direction. Here, too, it is possible that the displacement rate v is set to a value less than $$\frac{\dot{\Delta r}}{\tan(\alpha)}$$

over a relatively long time, or that the displacement rate v is only set to a value less than $$\frac{\dot{\Delta r}}{\tan(\alpha)}$$

within a limited time window during operation.

Consequently, the methods disclosed above cover opposite objectives. In one method, the local roll gap in the region of the strip edges is increased and the strip edges are relieved of loading, whereas, in the other method, the local roll gap in the region of the strip edges is reduced in size and the strip edges are subjected to loading. In both cases, the region of the strip edges may comprise up to 20% of the strip width.

In particular, in hot rolling of very thin strips, for example with a thickness of between 0.5 and 2 mm, in a rolling stand, especially the planarity and to a lesser extent the profile of the strip is influenced by the methods according to the invention. The reason for this is that the so-called transverse flow is small for very thin strips. By contrast, when applying the methods according to the invention in the case of strips with a thickness of >2 mm, especially the profile and to a lesser extent the planarity of the strip are influenced.

It has been found in studies carried out by the applicant that the profile and/or the planarity of the rolled strip can be specifically influenced by the axial displacement distance s or the axial displacement rate v of the working rollers dependent on the wear Δr or the rate of wear $\dot{\Delta}r$. It has thus been found that an axial displacement of a working roller by a displacement distance $$\Delta s < \frac{\Delta r}{\tan(\alpha)}$$

or a displacement rate $$v \equiv \dot{s} < \frac{\dot{\Delta} r}{\tan(\alpha)}$$

leads to a local reduction in the size of the roll gap in the region of the strip edges of the strip and to a loading of the strip edges. On the other hand, it has been found that an axial displacement of a working roller by a displacement distance $$\Delta s > \frac{\Delta r}{\tan(\alpha)}$$

or a displacement rate $$v \equiv \dot{s} > \frac{\dot{\Delta} r}{\tan(\alpha)}$$

leads to a local increase in the size of the roll gap in the region of the strip edges of the strip and to relief of the loading of the strip edges.

The object according to the invention is likewise achieved by an apparatus for locally changing a roll gap in the region of the strip edges of a rolled strip in a rolling stand. The rolling stand comprises:

- an upper working roller and a lower working roller, wherein each working roller has two ends for the rotational mounting of the working roller in chocks,
- wherein each working roller has in the axial direction a conical portion followed by a running surface,
- wherein the upper working roller is arranged in the opposite direction to the lower working roller,
- a separate displacing device for the upper working roller and the lower working roller are for axially displacing the working roller,
- a device for determining the wear Δr or the rate of wear $\dot{\Delta}r$ of the running surface in the radial direction,
- a measuring instrument for determining the profile and/or the planarity of the rolled strip, wherein the measuring instrument is arranged downstream of the rolling stand in the direction of mass flow,
- a control device for axially displacing the working rollers in opposite directions in dependence on the wear Δr or the rate of wear $\dot{\Delta}r$ of the working rollers, and also the measured profile $PR_{actual}$ and/or the measured planarity $PL_{actual}$ of the rolled strip. The control device is connected in signaling terms to the device for determining the wear Δr or the rate of wear $\dot{\Delta}r$ and the measuring instrument for determining the profile and/or the planarity of the rolled strip.

The apparatus according to the invention is suitable for both locally increasing the size and locally reducing the size of a roll gap in the region of the strip edges of a rolled strip in a rolling stand. By increasing or reducing the size of the roll gap in the region of the strip edges, the profile and/or the planarity of the strip can be specifically influenced.

The device for determining the radial wear or the rate of wear $\dot{\Delta}r$ of the running surface of the working rollers determines the wearing of the running surface in the radial direction. The determination may either be performed by measuring technology, or is preferably performed with the aid of a wear model, which for example takes into account the rolling force F, the distance covered by the working roller $s_{extent}$ and/or the rolling time. The distance covered by the working roller is determined according to $s_{extent}=r\cdot\varphi$, where φ indicates the angle in radians for the revolutions covered by the working roller. For further details of the wear model, reference is made to EP 2 548 665 B1.

The measuring instrument for determining the profile or the planarity of the rolled strip may determine the measured variables either without contact, for example optically or electromagnetically, or with contact, for example by a measuring roller. Here, the measuring instrument is arranged downstream of the rolling stand in the direction of mass flow, but preferably still upstream of a cooling zone for cooling down the hot-rolled strip.

In an advantageous embodiment, the device for determining the wear Δr or the rate of wear $\dot{\Delta}r$ of the running surface is connected to a thickness measuring device for measuring the thickness of the rolled strip and to a device for determining the distance between the upper working roller and the lower working roller. The distance, typically vertical distance, between the working rollers and the measured thickness of the strip can be used to determine the wear or the rate of wear.

According to an alternative embodiment, the device for determining the wear Δr or the rate of wear $\dot{\Delta}r$ of the running surface has a wear model (see EP 2 548 665 B1). The wear model is connected at least to one from the group comprising a rolling force measuring instrument for determining the rolling force F, the distance covered by the working roller $s_{extent}$ and a timer for determining the rolling time.

The displacing device itself may be for example an electromechanical drive (for example a recirculating ball screw with an electric motor) or a hydraulic drive.

BRIEF DESCRIPTION OF THE DRAWINGS

Further advantages and features of the present invention are provided by the following description of non-restrictive exemplary embodiments, wherein, in the FIGURES:

FIGS. 3A-3D show a representation of a method not according to the invention for the hot rolling of a rolled strip in a roll gap of a rolling stand; wherein FIG. 3A shows hot rolling a strip in a roll gap, for a first strip thickness;

FIG. 3B shows the rollers for the strip of FIG. 3A after the rollers are worn;

FIG. 3C shows the rollers for the strip of FIG. 3A worn further;

FIG. 3D shows a detail of FIG. 3C with wearing edges for wearing strip edge portions;

FIGS. 4A-4D show a representation of a method not according to the invention for the hot rolling of a strip in a roll gap of a rolling stand, showing displacement of the working rollers following the wear, wherein FIG. 4A shows the rollers not axially displaced;

FIG. 4B shows a first axial displacement of the rollers;

FIG. 4C shows a greater second axial displacement of the rollers;

FIG. 4D shows the result of rolling with non-profiled rollers;

FIGS. 5A-5D show a representation of a method according to the invention for locally increasing the size of a roll gap in the region of the strip edges of a rolled strip, wherein FIG. 5A shows the rollers not displaced axially;

FIG. 5B shows a first axial displacement distance of the rollers;

FIG. 5C shows a second axial displacement of the rollers;

FIG. 5D shows a detail of FIG. 5C and shows control of the roll gap at the strip edges;

FIGS. 6A-6D show a representation of a method according to the invention for locally reducing the size of a roll gap in the region of the strip edges of a rolled strip, wherein FIG. 6A shows the rollers not displaced axially;

FIG. 6B shows another axial displacement of the rollers;

FIG. 6C shows an effect of wear of the running surface of a roller providing a roller displacement distance;

FIG. 6D shows a detail of FIG. 6C showing reduction of the local roll gap on the regions of the strip edges.

DESCRIPTION OF EMBODIMENTS

Figure 1:
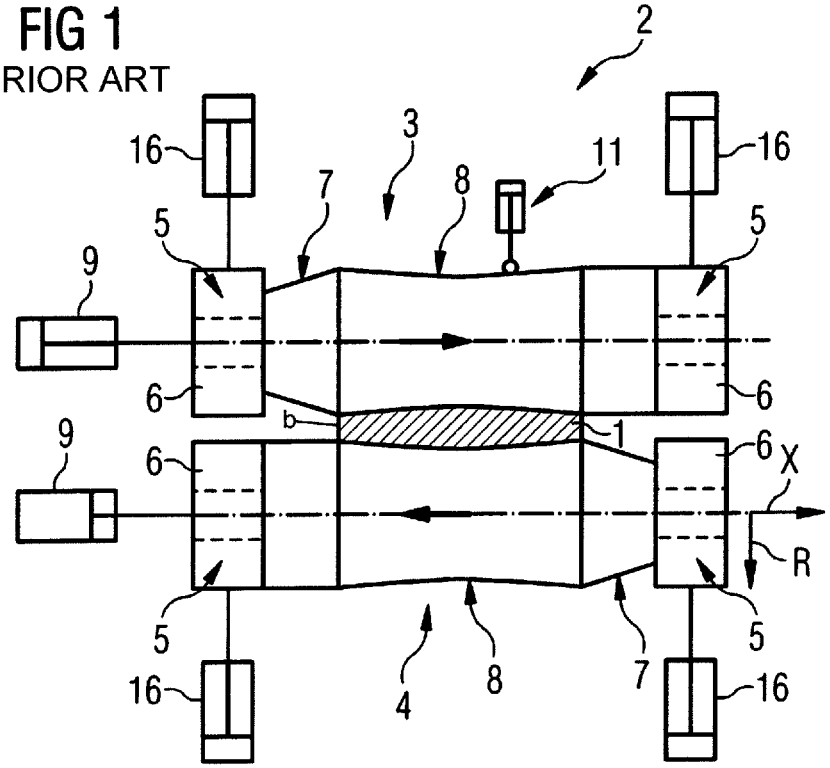
FIG 1 PRIOR ART
FIG. 1 shows a schematic representation of a rolling stand with an upper working roller and a lower working roller for locally changing the roll gap in the region of the strip edges of a rolled strip.

FIG. 1 schematically shows a rolling stand 2 as part of an apparatus for locally changing a roll gap in the region of the strip edges 10 of a rolled strip 1. The specific local changing of the roll gap in the region of the strip edges 10 allows the profile and/or the planarity of the strip 1 to be influenced during hot rolling. The rolled stock is hot-rolled in the roll gap between the upper working roller 3 and the lower working roller 4. Each working roller 3, 4 has two ends 5, which are respectively fitted displaceably in a chock 6 in a roller housing (not represented) of the rolling stand 2.

Figure 7:
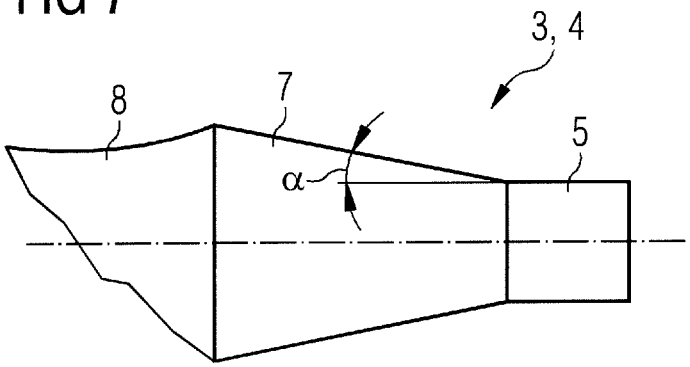
FIG. 7 shows a schematic representation of a portion of a working roller

Furthermore, each working roller 3, 4 comprises a conical portion 7 and a running surface 8 (also see FIG. 7). The upper working roller 3 is fitted in the rolling stand 2 in the opposite axial direction to the lower working roller 4.

The upper working roller 3 and the lower working roller 4 can each be displaced in the axial direction by respective separate displacing devices 9 during operation. The upper working roller 3 is displaced to the right during operation. The lower working roller 4, on the other hand, is displaced to the left (see arrows). Furthermore, the overall roll gap between the upper working roller 3 and the lower working roller 4 can be set by adjusting devices 16.

In order to be able to ascertain the wear of the running surface 8 of the upper working roller 3 during operation, the upper working roller has a device 11 for determining the wear or a wear model. A single device 11 or a single wear model is sufficient if the working rollers 3, 4 are produced from the same material. Of course, it is likewise possible that the upper working roller 3 and the lower working roller 4 respectively have a separate device for determining the wear 11 or a wear model. The measurement of the wear $\Delta r$ or the rate of wear $\dot{\Delta} r$ of the running surface 8 of the working rollers 3, 4 in the radial direction may be performed with contact, for example by a roller which contacts the running surface 8, or without contact, for example optically. Since the axial displacement of the working rollers in the rolling stand to compensate for wear is already known from WO 2017/215595 A1, this document is incorporated by reference. However, it is not known from this document how the local roll gap can be specifically changed in the region of the strip edges of the strip.

Figure 2:
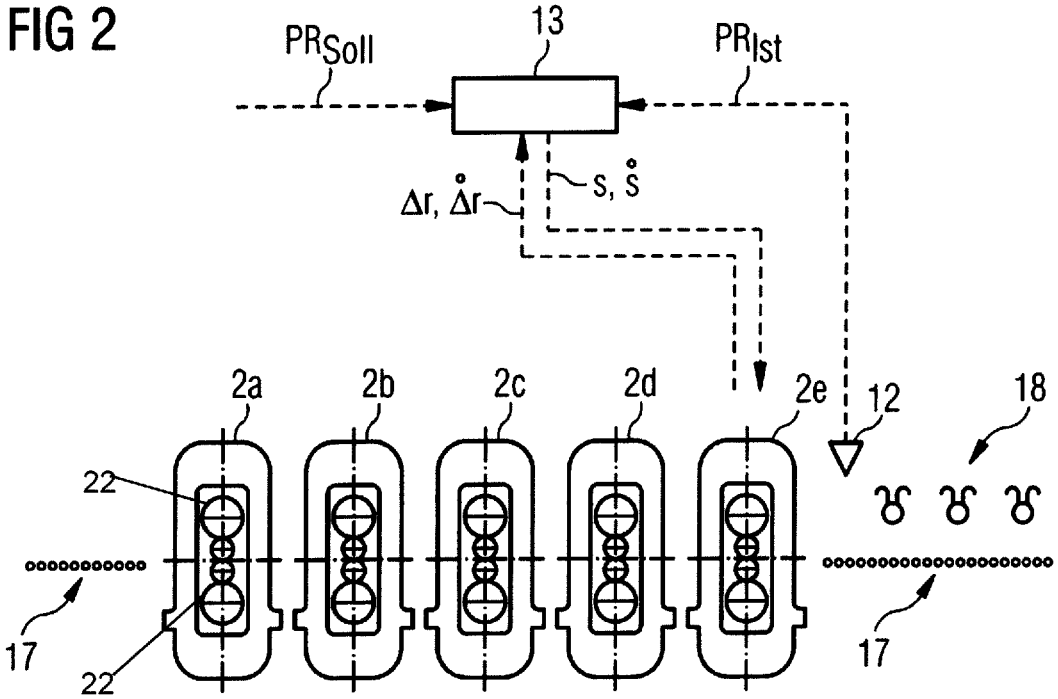
FIG. 2 shows a schematic representation of an apparatus according to the invention for locally changing the roll gap in the region of the strip edges of a rolled strip with the rolling stand as shown in FIG. 1.

In FIG. 2, back up rollers 22 are shown at each working roller 3,4. In the FIGURES that follow FIG. 2, the backup rollers are not shown for reasons of overall clarity. Any person skilled in the art in the field of rolling mill technology knows that backup rollers are customary and that they counteract bending of the working rollers.

In FIG. 2, an apparatus for locally changing the roll gap in the region b of the strip edges of a rolled strip in a rolling stand 2 of a five-stand finishing roll train, for example in a combined casting/rolling installation, is schematically represented. The rolled stock (not represented) is fed by a roller table 17 to the finishing roll train with the rolling stands 2*a* to 2*e* and are finish-rolled there in the hot state. In the last rolling stand 2*e*, the wear $\Delta r$ or the rate of wear $\dot{\Delta} r$ of the running surfaces 8 of the working rollers 3, 4 is ascertained by measuring technology used by the device 11 (see FIG. 1). Alternatively, it is likewise possible not to ascertain $\Delta r$ or $\dot{\Delta} r$ by measuring technology, but by using a so-called wear model.

The apparatus also comprises a measuring instrument 12 for determining the profile or the planarity of the rolled strip. This measuring instrument is arranged downstream of the rolling stand 2 in the direction of mass flow. In the specific case, the actual profile $PR_{actual}$ is fed to a control device 13. Apart from the actual profile, the desired profile $PR_{desired}$ is also fed to the control device 13. Taking into account the wear $\Delta r$ or the rate of wear $\dot{\Delta} r$, the measured profile $PR_{actual}$ and the desired profile $PR_{desired}$, the control device 13 calculates the displacement distance s or the displacement rate $\dot{s}$ for the upper working roller 3 and the lower working roller 4 (see FIG. 1). The local roll gap in the region of the strip edges of the strip can be specifically changed by axially displacing the working rollers 3, 4 more quickly or more slowly. For very thin strips, this has an effect especially on the planarity of the strip. In contrast, for thicker strips, the local changing of the roll gap in the region of the strip edges has an effect especially on the profile of the rolled strip. After the finish-rolling, the rolled strip is cooled down in a cooling zone 18 and is subsequently conveyed out.

The methods for locally changing a roll gap in the region b of the strip edges 10 of a rolled strip are explained below on the basis of FIGS. 3A-3D, 4A-4D, 5A-D and 6A-6D.

Figure 3A:
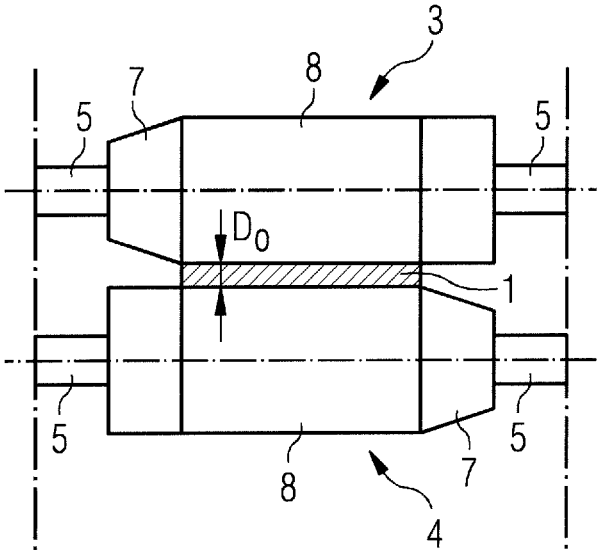
FIG 3A PRIOR ART

In FIG. 3A, a strip 1 is hot-rolled in the roll gap between the upper working roller 3 and the lower working roller 4. At the beginning, the strip has a thickness Do. Both working rollers 3, 4 respectively have two ends 5, a conical portion 7 and a running surface 8. The upper working roller 3 is fitted in the opposite direction to the lower working roller 4.

Figure 3B:
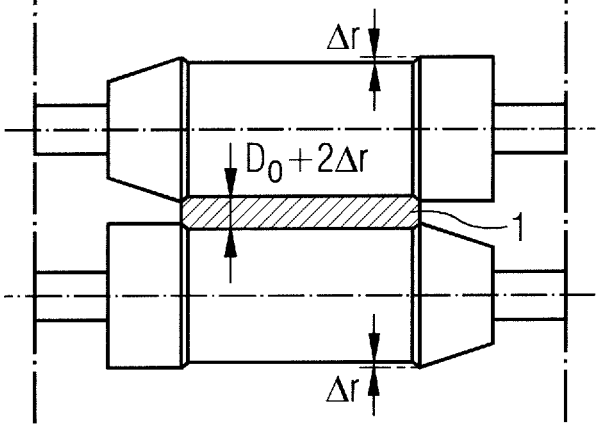
FIG 3B PRIOR ART

After a certain rolling time, the running surfaces 8 of the working rollers 3, 4 are worn in the radial direction by an amount $\Delta r$ (see FIG. 3B). If the vertical distance between the two working rollers 3, 4 is kept constant, the rolled strip 1 then has a thickness of $D_0+2\Delta r$. Continuing the hot rolling has the effect that the running surfaces 8 of the working rollers 3, 4 become worn by the amount $2\cdot\Delta r$ (see FIG. 3C), so that the thickness of the strip 1 is then $D_0+4\Delta r$.

It is possible to compensate for the change in thickness of the rolled strip 1 by an adjustment of at least one working roller 3 or 4 (see WO 2017/215595 A1).

Figure 3C:
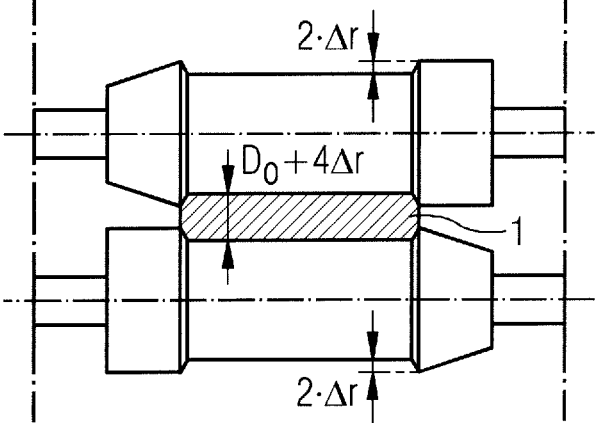
FIG 3C PRIOR ART
Figure 3D:
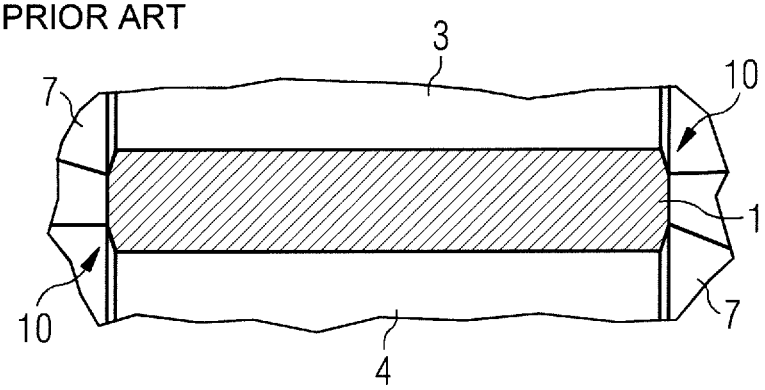
FIG 3D PRIOR ART

As can be seen in FIG. 3D, which shows a detail of FIG. 3C, pronounced wearing edges, which lead to a local reduction in the size of the roll gap in the region of the strip edges 10 or to a loading of the strip edges of the rolled strip 1, form in the working rollers 3, 4. As a result, the rolled strip 1 is thinner in the region of the strip edges 10 than in the central region of the strip 1. Since the working rollers 3, 4 are not axially displaced during the hot rolling, the method is not according to the invention.

In FIGS. 4A-4D, the working rollers 3, 4 are axially displaced such that an upper strip edge 10 and a lower strip edge 10 of the strip 1 always rest on an edge between the conical portion 7 and the newly formed (because worn) running surface 8 of the respective working roller 3, 4. The displacement distance of a working roller 3, 4 in the axial direction in this case satisfies the condition $$s = \frac{\Delta r}{\tan(\alpha)},$$

where Δr indicates the wear of a working roller 3, 4 in the radial direction and a indicates the pitch angle of the conical portion. In an equivalent way, the displacement may be set out as governed by the rate of wear $\dot{\Delta r}$, a working roller 3, 4 then being displaced in the axial direction at an axial rate of $$v \equiv \dot{s} = \frac{\dot{\Delta r}}{\tan(\alpha)}.$$

Figure 4A:
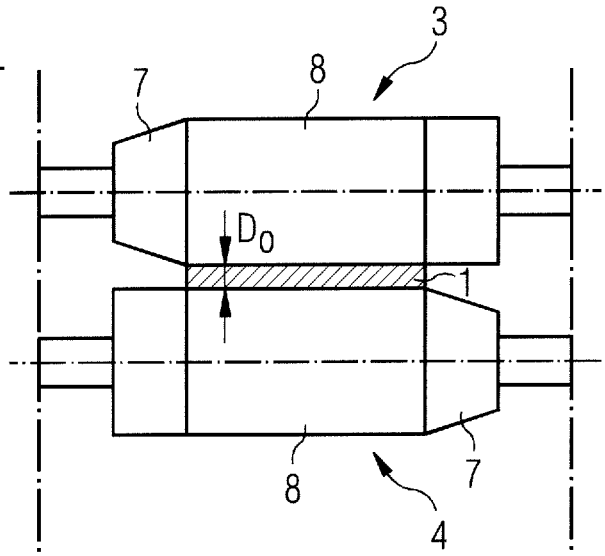
FIG 4A PRIOR ART
Figure 4B:
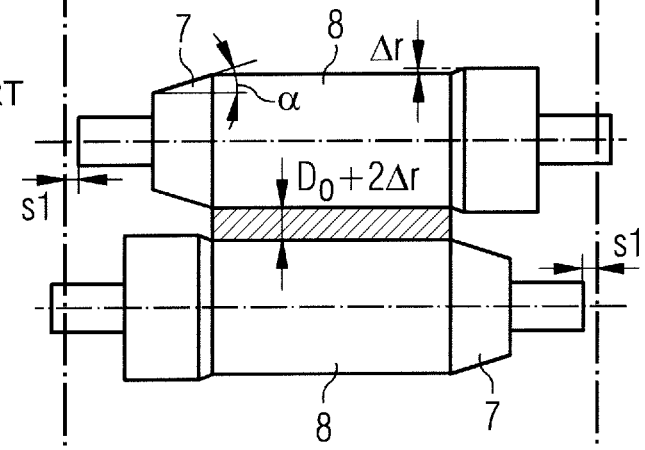
FIG 4B PRIOR ART

According to FIG. 4B, the wear of the running surface 8 of the working rollers 3, 4 is Δr, which gives a displacement distance of $$s1 = \frac{\Delta r}{\tan(\alpha)}.$$

Figure 4C:
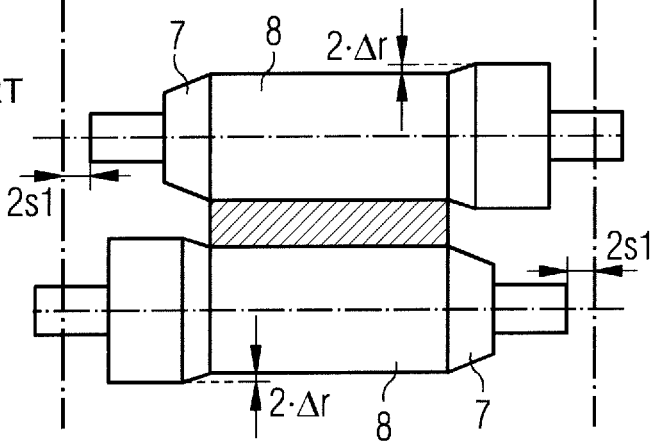
FIG 4C PRIOR ART

According to FIG. 4C, the wear of the running surface 8 of the working roller 3, 4 is $2\cdot\Delta r$, which gives a displacement distance of $$2.\ s1 = \frac{2\Delta r}{\tan(\alpha)}.$$

The upper working roller 3 is in this case displaced to the right and the lower working roller 4 to the left.

Figure 4D:
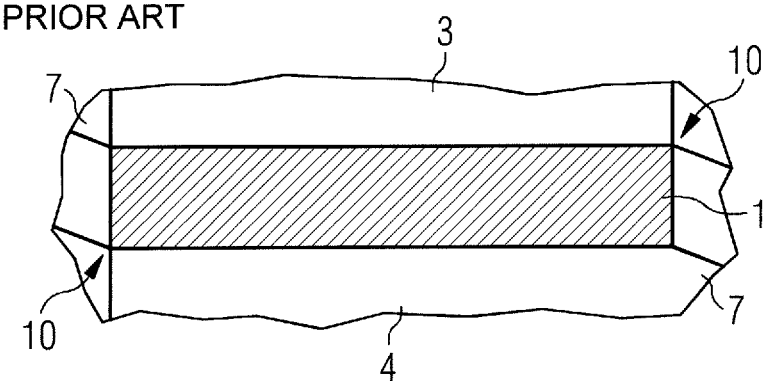
FIG 4D PRIOR ART

As can be seen from FIG. 4D, this method has the effect that, using a non-profiled working roller 3, 4, the strip 1 has a constant thickness over the width. In other words, the rolled strip 1 is just as thin in the region of the strip edges 10 as in the central region of the strip 1. According to this method which is not according to the invention, the local roll gap in the region of the strip edges is not changed and the strip edges of the strip 10 are neither subjected to loading nor relieved of loading.

Figure 5A:
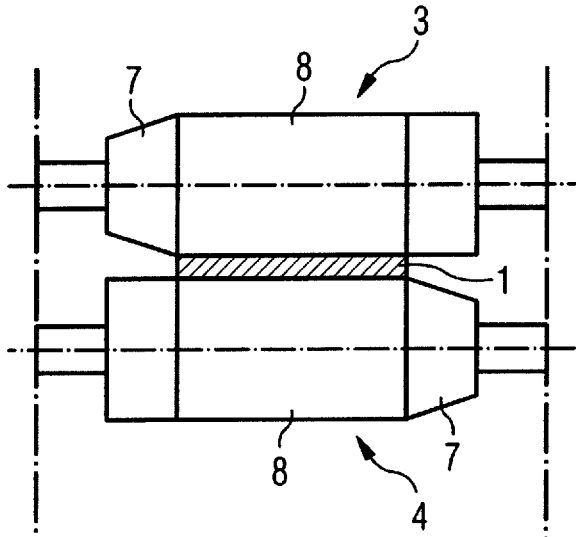
Figure 5B:
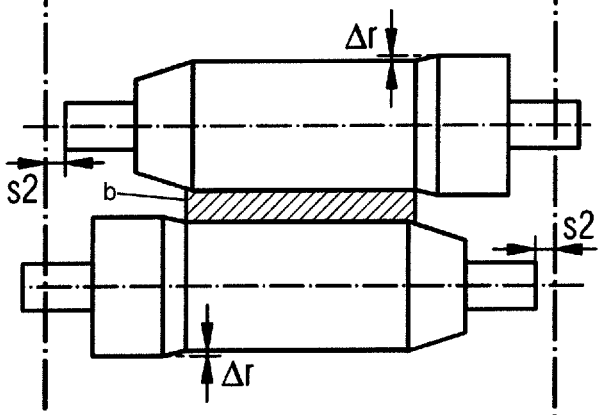
Figure 5C:
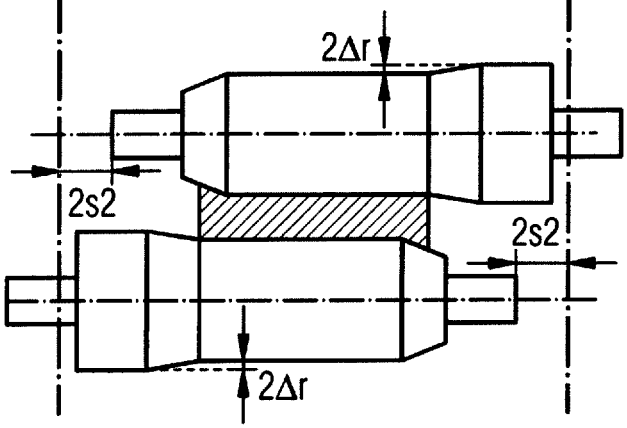

In contrast to the prior art, in FIGS. 5A-5D, the working rollers 3, 4 in FIG. 5A are axially displaced as in FIGS. 5B and 5C, such that an upper strip edge 10 at the left side in FIGS. 5B and 5C and a lower strip edge 10 to the right side of the strip 1 always rest on the respective conical portion 7 of the respective working roller 3, 4. The displacement distance of a working roller 3, 4 in the axial direction in this case satisfies the condition $$s > \frac{\Delta r}{\tan(\alpha)},$$

where Δr indicates the wear of a working roller 3, 4 in the radial direction and α indicates the pitch angle of the conical portion. In an equivalent way, if the displacement may be set out as governed by the rate of wear $\dot{\Delta r}$, a working roller 3, 4 is then being displaced in the axial direction at an axial rate of $$v \equiv \dot{s} > \frac{\dot{\Delta r}}{\tan(\alpha)}.$$

According to FIG. 5B, the wear of the running surface 8 of the working roller 3, 4 is Δr. This provides a displacement distance of $$s2 > \frac{\Delta r}{\tan(\alpha)}.$$

According to FIG. 5C, the wear of the running surface 8 of the working roller 3, 4 is $2\cdot\Delta r$. This provides a displacement distance of $$2.\ s2 > \frac{2\Delta r}{\tan(\alpha)}.$$

The upper working roller 3 is in this case displaced to the right and the lower working roller 4 to the left.

Figure 5D:
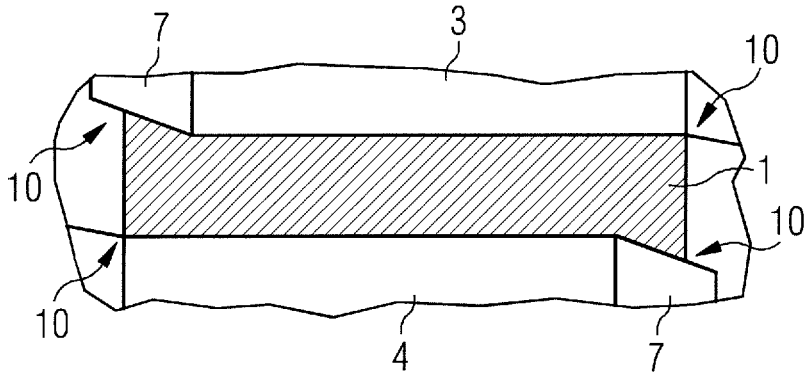

As can be seen in FIG. 5D, which shows a detail of FIG. 5C, by this method the local roll gap in the region of the strip edges 10 of the rolled strip 1 is increased in size or the strip edges are relieved of loading. As a result, the rolled strip 1 is thicker in the region of the strip edges 10 than in the central region of the strip 1.

In FIGS. 6A-6D, the working rollers 3, 4 are axially displaced such that the displacement distance of a working roller 3, 4 in the axial direction satisfies the condition $$s < \frac{\Delta r}{\tan(\alpha)},$$

where Δr indicates the wear of a working roller 3, 4 in the radial direction and α indicates the pitch angle of the conical portion. In an equivalent way, in FIG. 6B the displacement may be set out as governed by the rate of wear $\dot{\Delta}r$, a working roller 3, 4 then being displaced in the axial direction at an axial rate of $$v \equiv \dot{s} < \frac{\dot{\Delta}r}{\tan(\alpha)}.$$

Figure 6A:
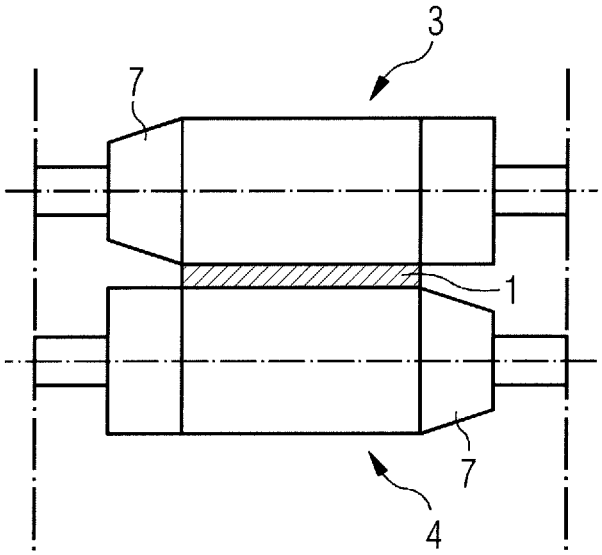
Figure 6B:
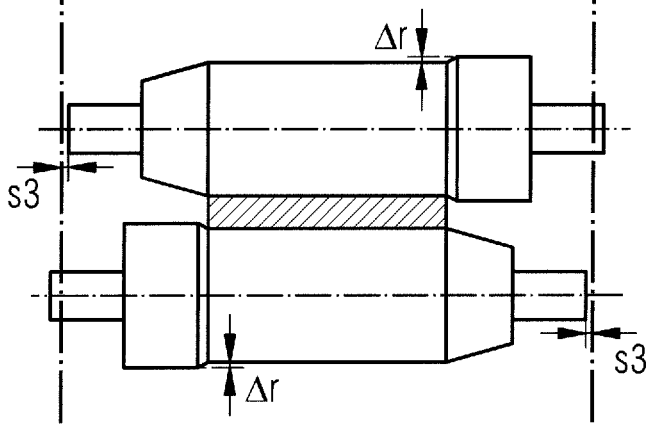

According to FIG. 6B, the wear of the running surface 8 of the working roller 3, 4 is $\Delta r$. This provides a displacement distance of $$s3 < \frac{\Delta r}{\tan(\alpha)}.$$

Figure 6C:
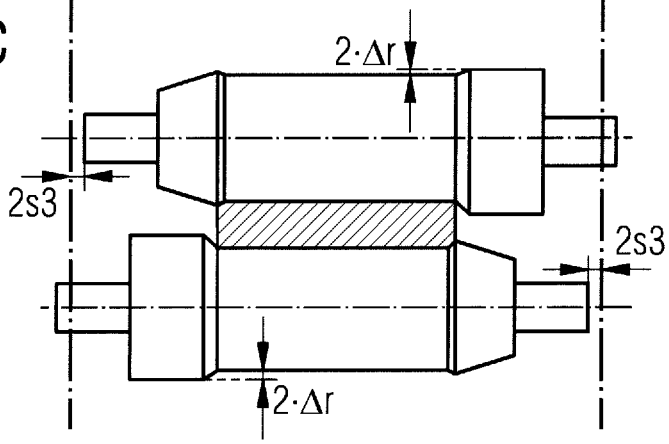

According to FIG. 6C, the wear of the running surface 8 of the working roller 3, 4 is $2 \cdot \Delta r$. This provides a displacement distance of $$2.\ s3 < \frac{2\Delta r}{\tan(\alpha)}.$$

The upper working roller 3 is in this case displaced to the right and the lower working roller 4 to the left.

Figure 6D:
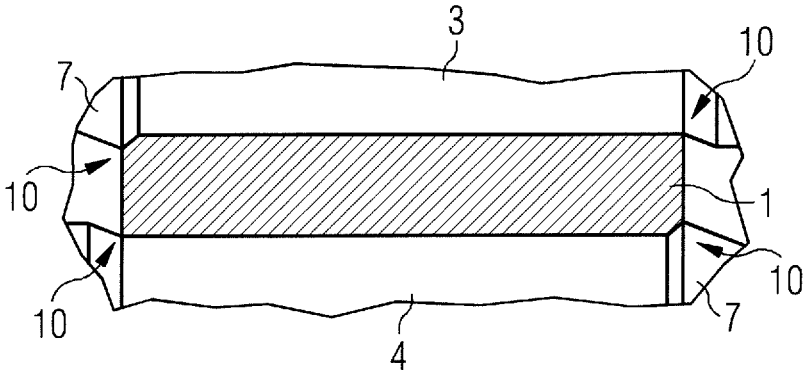

As shown in FIG. 6D, which shows a detail of FIG. 6C, this method reduces the local roll gap in the region of the strip edges 10 of the rolled strip 1 in size or the strip edges are subjected to loading. As a result, the rolled strip 1 is thinner in the region of the strip edges 10 than in the central region of the strip 1.

FIG. 7 shows the geometrical definition of the pitch angle $\alpha$ of the conical portion 7 of a working roller.

Figure 8:
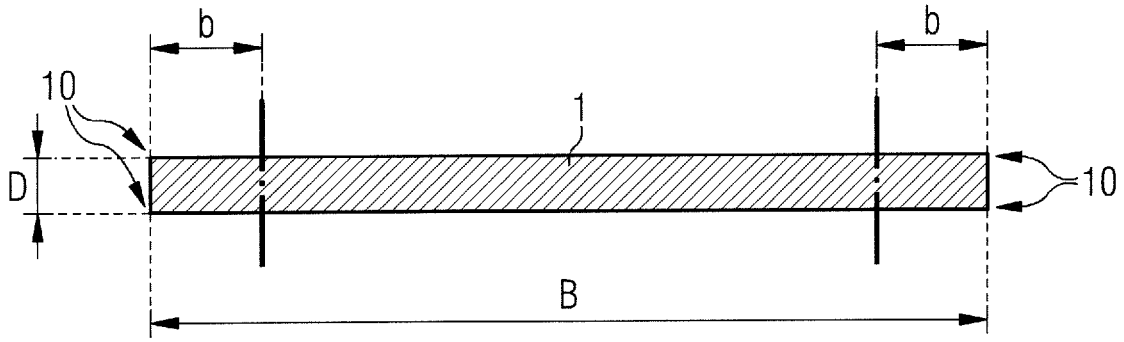
FIG. 8 shows a schematic representation of the regions of the strip edges of a rolled strip

Finally, FIG. 8 schematically shows the regions b of the strip edges 10 of a strip 1. Typically, the longitudinal extent of the two regions b of the strip edges is up to 10 or 20% of the strip width B, wherein one region b of the strip edges can account for up to 5 or 10% of the strip width B.

Although the invention has been illustrated more specifically and described in detail by the preferred exemplary embodiments, the invention is not restricted by the examples disclosed and other variations can be derived therefrom by a person skilled in the art without departing from the scope of protection of the invention.

LIST OF DESIGNATIONS

1 Strip
2, 2*a* . . . 2*e* Rolling stand
3 Upper working roller
4 Lower working roller
End of a working roller
6 Chock
7 Conical portion
8 Running surface
9 Displacing device
Strip edge
11 Device for determining the wear or the rate of wear
12 Measuring instrument for determining the profile and/or the planarity
13 Control device for axially displacing the upper working roller and the lower working roller
14 Thickness measuring device
Device for determining the distance between the upper working roller and the lower working roller
16 Adjusting device
17 Roller table
18 Cooling zone
B Width of the strip
b Region of the strip edge
D Thickness of the strip
F Rolling force
$PR_{desired}$ Desired profile
$PR_{actual}$ Actual profile
r Radius
R Radial direction
$\Delta r$ Wear of the running surface in the radial direction
$\dot{\Delta}r$ Rate of wear of the running surface in the radial direction
s Displacement distance
$S_{extent}$ Distance covered by the working roller
v Displacement rate
X Axial direction
$\alpha$ Pitch angle of the conical portion
() First time derivative

The invention claimed is:

1. A method for locally increasing a size of a roll gap in a region of strip edges of a rolled strip in a rolling stand, wherein the rolling stand comprises:

an upper working roller and a cooperating lower working roller, the rollers extending parallel to each other and defining a gap between the rollers, the rollers cooperating for passage of the rolled strip through the gap between the rollers;

each working roller having two opposite ends configured for rotational mounting of the working roller;

each working roller having, in a respective axial direction thereof, a conical portion followed by a running surface;

the upper working roller is oriented in an opposite axial direction to the lower working roller;

each working roller having a respective separate displacing device configured and operable for axially displacing the respective working roller;

the method comprising:

determining a radial wear $\Delta r$ of the running surface of at least one of the working rollers in a radial direction thereof, and hot rolling a rolled stock in the rolling stand through the gap between the rollers, and causing the radial extent of the running surface of at least one of the working rollers to decrease by $\Delta r$ during the rolling, while axially displacing the working rollers in opposite axial directions by a displacement distance $$s > \frac{\Delta r}{\tan(\alpha)},$$

where $\alpha$ indicates a pitch angle of the conical portion of the respective working roller.

2. A method for locally increasing a size of a roll gap in a region of strip edges of a rolled strip in a rolling stand, wherein the rolling stand comprises:

an upper working roller and a cooperating lower working roller, the rollers extending parallel to each other and defining a gap between the rollers, the rollers cooperating for passage of the rolled strip through the gap between the rollers;

each working roller having two opposite ends configured for rotational mounting of the working roller;

each working roller having, in a respective axial direction thereof a conical portion followed by a running surface;

the upper working roller is oriented in an opposite axial direction to the lower working roller;

each working roller having a respective separate displacing device for axially displacing the respective working roller;

the method comprising:

determining a rate of radial wear ($\dot{\Delta}r$) of the running surface of at least one of the working rollers in a radial direction thereof, and hot rolling a rolled stock in the rolling stand through the gap between the rollers, and causing the radial extent of the running surface of at least one of the working rollers to decrease at a rate of $\dot{\Delta}r$ during the rolling, while axially displacing the working rollers in opposite axial directions at a displacement rate of $$v \equiv \dot{s} > \frac{\dot{\Delta r}}{\tan(\alpha)},$$

where α indicates a pitch angle of the conical portion of the respective working roller.

3. A method for locally reducing a size of a roll gap in a region of strip edges of a rolled strip in a rolling stand, wherein the rolling stand comprises:

an upper working roller and a cooperating lower working roller, the rollers extending parallel to each other and defining a gap between the rollers, the rollers cooperating for passage of the rolled strip through a gap between the rollers;

each working roller having two opposite ends configured for the rotational mounting of the working roller;

each working roller having in a respective axial direction thereof a conical portion followed by a running surface;

the upper working roller is oriented in an opposite axial direction to the lower working roller;

each working roller having a respective separate displacing device configured and operable for axially displacing the respective working roller;

the method comprising:

determining a radial wear Δr of the running surface of at least one of the working rollers in a radial direction thereof, hot rolling a rolled stock in the rolling stand in the gap between the rollers, the radial extent of the running surface of at least one of the working rollers decreases by Δr during the rolling; and axially displacing the working rollers in opposite axial directions by a displacement distance $$s < \frac{\Delta r}{\tan(\alpha)},$$

where α indicates a pitch angle of the conical portion of the respective working roller.

4. A method for locally reducing a size of a roll gap in a region of strip edges of a rolled strip in a rolling stand, wherein the rolling stand comprises:

an upper working roller and a cooperating lower working roller, each working roller having two opposite ends configured for the rotational mounting of the working roller each working roller having, in a respective axial direction thereof, a conical portion followed by a running surface;

the upper working roller is oriented in an opposite axial direction to the lower working roller;

each working roller having a respective separate displacing device configured and operable for axially displacing the working respective roller;

the method comprising:

determining a rate of radial wear $\dot{\Delta}r$ of the running surface of at least one of the working rollers in a radial direction thereof, and hot rolling a rolled stock in the rolling stand in the gap between the rollers, and causing the radial extent of the running surface of at least one of the working rollers to decrease at a rate of wear $\dot{\Delta}r$ during the rolling, while axially displacing the working rollers in opposite axial directions at a displacement rate of $$v \equiv \dot{s} < \frac{\dot{\Delta r}}{\tan(\alpha)},$$

where α indicates a pitch angle of the conical portion of the respective working roller.

5. The method as claimed in claim 1, further comprising: for thin strips with a thickness of between 0.5 and 2 mm, setting a planarity of the strip.

6. The method as claimed in claim 4, further comprising for strips with a thickness of >2 mm, setting a profile of the strip.

* * * * *